United States Patent [19]

Berry et al.

[11] Patent Number: 4,766,339

[45] Date of Patent: Aug. 23, 1988

[54] ELECTRIC LAMP WITH REINFORCED FILAMENT STRUCTURE

[75] Inventors: William L. Berry; Robert S. Coney, both of Winchester; Stephen P. Senft, Lexington, all of Ky.

[73] Assignee: GTE Products Corporation, Danvers, Mass.

[21] Appl. No.: 26,324

[22] Filed: Mar. 16, 1987

[51] Int. Cl.[4] ..... H01J 61/10

[52] U.S. Cl. ..... 313/276; 313/273; 313/274; 313/279; 313/579

[58] Field of Search ..... 313/271, 273, 331, 578, 313/579, 580, 276, 275, 274, 277, 278, 315

[56] References Cited

U.S. PATENT DOCUMENTS

| | | | |
|---|---|---|---|
| 3,781,582 | 12/1973 | De Caro | 313/271 X |
| 4,032,809 | 6/1977 | Corth | 313/578 X |
| 4,366,411 | 12/1982 | Robinson | 313/273 X |

*Primary Examiner*—David K. Moore
*Assistant Examiner*—Mark R. Powell
*Attorney, Agent, or Firm*—Lawrence R. Fraley

[57] ABSTRACT

An improved electric lamp including an envelope having a sealed end portion, a coiled tungsten filament structure within the envelope, a pair of tungsten lead-in conductors sealed within the envelope and coupled to the filament structure, a first insulative (e.g., quartz) bridge disposed within the envelope between the filament and the envelope's sealed end, and a pair of support wires which also extend within the envelope adjacent the lead-in conductors respectively, to provide support for the contained filament structure. The improvement comprises reinforcement means in the form of a pair of platinum-clad molybdenum wire members each having a smaller diameter than that of the lead-in conductors and support wires, each of these wire members being welded to a respective pair of said conductor and support wire elements at a location between the lower bridge and sealed end. The wire members may be of curvilinear (e.g. U-shaped) configuration or of straight configuration, or a combination of both.

9 Claims, 1 Drawing Sheet

ELECTRIC LAMP WITH REINFORCED FILAMENT STRUCTURE

TECHNICAL FIELD

The invention relates to electric lamps and particularly to such lamps wherein a filament structure is supported within the envelope thereof.

BACKGROUND

Lamps of the above type are known. In one example thereof, a filament structure including a plurality of individual coiled filaments is suspended within the lamp's glass envelope. Electrical connection to the filament structure is accomplished by a pair of lead-in conductors which pass through an end of the envelope and are electrically coupled to selected parts of the structure. Support wires have also been used in such lamps to provide support for the filament structure, e.g., at an end (or side) opposite that to which the aforementioned conductors are coupled. In a specific example, the support wires were embedded within a glass bridge (from which one side of the filament structure was suspended) while the conductors passed through a second bridge located on an opposite side of the structure and from which the structure was also suspended. In such an example, reinforced support for the structure within the lamp's envelope was attempted by directly welding the support wires and conductors together at a point above the bridge (and immediately below the filament). Such a jointure, being so located, was often somewhat difficult to achieve and also occasionally proved unacceptable because it was not properly made. Specifically, the jointure, typically provided by welding using an interim platinum tab, occasionally broke if the weld was not "hot" enough. If too "hot", embrittlement of the support wire(s) occasionally occurred, in turn also resulting in a break at this location when the filament structure (and containing lamp) was subjected to mechanical shock (e.g., during shipping). Still further, reliable control of the welding operation needed to provide such connection (between support wires and conductors) was exceptionally difficult to maintain.

DISCLOSURE OF THE INVENTION

It is, therefore, a primary object of the instant invention to enhance the electric lamp art by providing an electric lamp having a reinforced filament structure support assembly which overcomes the several disadvantages cited above.

It is a further object to provide such a lamp which can be manufactured using mass production techniques and which is thus relatively inexpensive to produce.

These and other objects are accomplished, in accordance with one aspect of the invention, by the provision of an electric lamp having an envelope with a sealed end, a filament structure within the envelope, an insulative bridge within the envelope between the filament and sealed end, a pair of lead-in conductors coupled to the filament, and a pair of support wires within the envelope for supporting the filament. The improvement comprises providing reinforcement means (e.g., wire members) designed to interconnect a respective one of the support wires to a corresponding, respective lead-in conductor at a location between the bridge and sealed end.

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
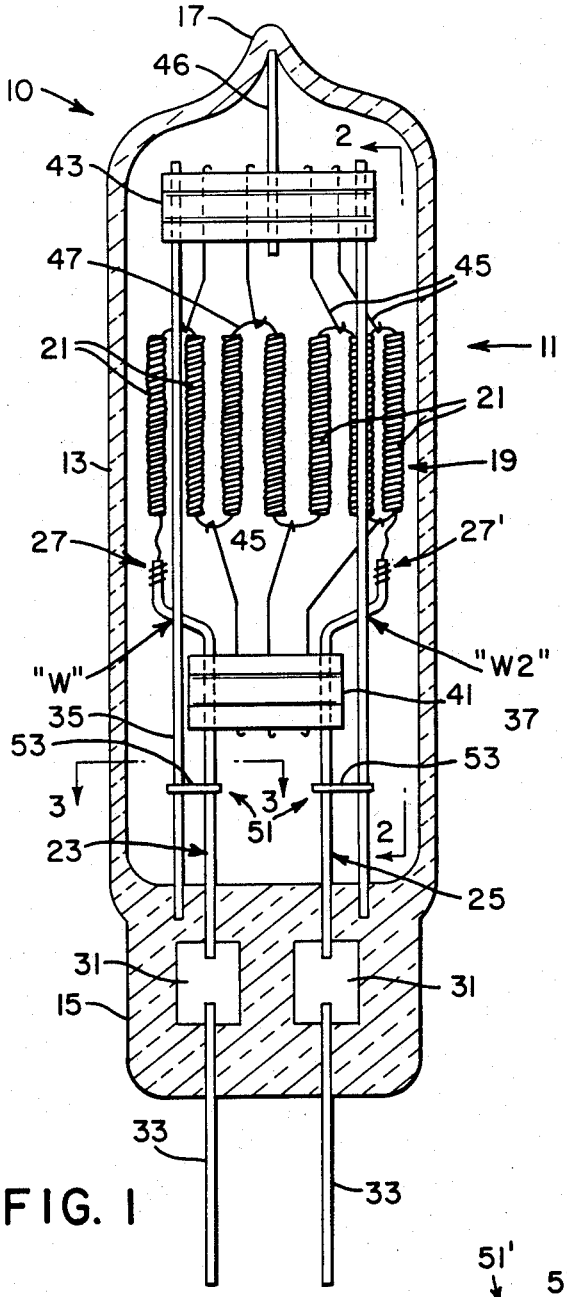
FIG. 1 is a front elevational view, in section, of an electric lamp in accordance with a preferred embodiment of the invention.

In FIG. 1, there is shown an electric lamp 10 in accordance with a preferred embodiment of the invention. Lamp 10 includes an envelope 11 having a hollow, bulbous portion 13 and a sealed end portion 15. End 15 is preferably provided using a press-sealing operation known in the art. Envelope 11 is glass (e.g., borosilicate). The opposite end (from sealed end 15) of envelope 11 is also sealed, but preferably utilizing a tipping operation, also known in the art. Accordingly, this end of envelope 11 includes a protruding tip segment 17. Lamp 10 also preferably includes a halogen atmosphere within envelope 11 and may thus also be referred to as a tungsten halogen lamp. Lamps having such internal atmospheres are known and widely used today ( e.g., in projection lighting) and further definition of this aspect of lamp 10 is thus not believed necessary. It must be understood, however, that the invention is not limited to this particular atmosphere, in that other atmospheres (e.g., an inert gas such as argon) and uses (e.g., as an infrared lamp) are possible. In one specific example, lamp 10 as produced in accordance with the teachings herein was operational at 2000 watts (120 V).

Substantially centrally disposed within envelope 11 is a filament structure 19 which, in a preferred embodiment, comprises a plurality of several, individual coiled tungsten filaments 21 electrically connected in series in a manner known in the art. Such a structure is also referred to in the art as a C13 type filament. The invention is not limited to this particular structure; however, in that other filament structures can be readily used herein.

Electrically coupled to filament structure 19 are first and second lead-in conductors 23 and 25, respectively. As shown in FIG. 1, each conductor is sealed within end 15 and extends within the bulbous portion 13 of envelope 11. More specifically, lead-in conductor 23 extends within envelope 11 and is connected to a first singular coiled filament 21 (that filament farthest to the left in FIG. 1) at a point of connection 27. Similarly, conductor 25 is coupled to the opposite end of the series structure at a point of connection 27'. In a preferred embodiment, each of the lead-in conductors 23 and 25 was comprised of a 0.030 inch diameter tungsten wire which, in addition to being coupled to filament structure 19 as indicated, also included a thin conductive foil segment (e.g., molybdenum foil) 31 sealed within end 15 and a second conductive wire (e.g., 0.030 inch diameter tungsten) 33 which, in addition to being connected to the opposite end of the sealed foil 31, projected externally from sealed end 15 in the manner indicated. It is understood, however, that lead-in conductors of other configurations and/or elements can also be readily used in the instant invention. For example, it is also within the scope of the invention to utilize a singular conductive wire element which passes from the interior of the envelope 11 through and externally from the sealed end 15. Use of thin molybdenum foils and an additional projecting conducting wire is preferred, however, to facilitate formation of the aforementioned press-seal for end 15.

Figure 2:
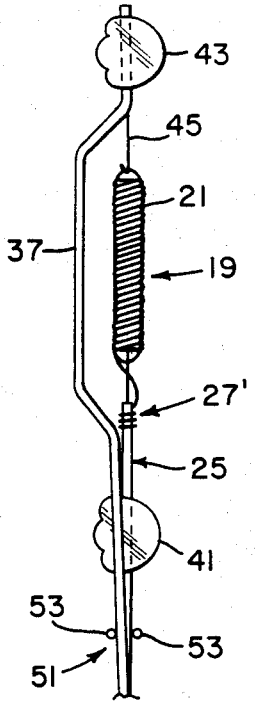
FIG. 2 is a partial side view, excluding lamp envelope, of the reinforced filament structure of FIG. 1 as taken along the line 2—2 therein.

As further shown in FIG. 1, also located within envelope 11 is a pair of filament support wires 35 and 37. Each wire is embedded a predetermined distance within the sealed end 15 and extends upwardly in a substantially parallel, electrically isolated manner from filament structure 19. Each suppport wire is preferably slightly bent to further assure adequate spacing from the several coiled filaments 21 (see FIG. 2). Preferably, each support wire 35 and 37 is also of tungsten material and, even more preferably, of substantially the same diameter (e.g., 0.030) as the respective lead-in conductors 23 and 25. In comparing FIG. 2, it is also seen that each support wire (only wire 37 being shown in FIG. 2) forms a slight acute angle relative to the corresponding, adjacent lead-in conductor (25) at the location below filament structure 19. Further, and as shown in both FIGS. 1 and 2, the respective lead-in conductors pass through and are thus sealed within a first insulative bridge 41 located within envelope 11 between the coiled filament structure 19 and press-sealed end 15. It is noted, however, that the support wires 35 and 37 pass externally of bridge 41 but are eventually sealed firmly within a second bridge 43 located within envelope 11 at the top thereof and thus on an opposite side (or end) of filament structure 19 from first bridge 41. Each bridge is preferably of glass (e.g., borosilicate or quartz) and is formed to the elongated configuration shown in the drawings.

Filament structure 19 is suspended within envelope 11 from both bridges through the utilization of a plurality of hook wires 45 which are embedded within bridges 41 and 43 in the manner shown and which each hook about a corresponding loop (i.e., loop 47) which interconnects a respective pair of singular coiled filaments 21. Each hook wire 45 is electrically isolated within the respective bridge and thus forms no part of the circuit of lamp 10. Such a manner of suspending a coiled filament structure is known in the art and further description is not believed necessary. It is understood from the above that the path of electrical current through lamp 10 is from one of the lead-in conductors (e.g., 23) through the several individual coiled filaments 21 and outwardly from envelope 11 through the remaining conductor (e.g., 25). Support wires 35 and 37 thus also do not form part of this circuit.

To further stabilize the lamp's internal structure, a third support wire 46 may be utilized. Wire 46 (e.g., of 0.030 inch diameter tungsten) is preferably embedded within the second bridge 43 and is sealed within the tip end of the envelope in the manner indicated.

It is thus understood from the foregoing that the support wires 23 and 25 form an integral part of the total supporting means for filament structure 19 in order that this structure be strategically positioned (e.g., centrally disposed) within envelope 11. In previous lamps of the type described wherein such additional support wire elements were utilized in combination with lead-in conductors such as described herein, it was known to provide added support for the lamp's internal structure by welding at least one of said support wires to a corresponding, respective one of the lead-in conductors at a location immediately below the filament structure but above the lower insulative bridge. One preferred location is represented by the letter "W" in FIG. 1, while a second weld (if used) was utilized at an alternate location "W2" on the opposite side of the envelope. As stated above, the formation of an effective jointure at this location (or locations) proved extremely difficult in order to adequately bond the respective support and lead-in conductor elements. For example, if a weld were not "hot" enough when made, the formed joint would be weak and subsequently result in breakage thereof (e.g., during lamp shipment). Alternatively, if the weld was not sufficiently "hot" when made, embrittlement of the tungsten support wires could occur which in turn would result in breakage from mechanical shock, again as may be experienced during shipment or similar handling of the lamp.

In accordance with the teachings of the instant invention, the aforementioned problems have been overcome by the provision of support reinforcement means 51 located below the lamp's first insulative bridge 41 and above the press-sealed end 15. Use of this reinforcement means at such a distant location from the filament structure 19 has, surprisingly, resulted in not only enhanced support of the structure, but elimination of the aforementioned welding problem. In this regard, it is understood that in accordance with the teachings of this invention, the aforementioned welding (at locations "W" and/or "W2" is not utilized such that a solid connection is not formed (or necessary) at these locations.

Figure 3:
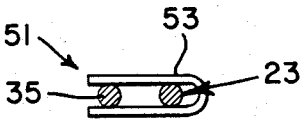
FIG. 3 is an enlarged, partial plan view of the reinforcement means of FIG. 1, as taken along the line 3—3 therein.

In a preferred embodiment, reinforcement means 51 comprises a pair of wire members 53 of curvilinear configuration, each of which is looped about and engaged to a singular support wire and adjacent lead-in conductor on opposite sides thereof. Such a configuration is best seen in FIG. 3, which in turn represents an enlarged view as taken along the line 3—3 in FIG. 1. Although it has been stated that preferably two wire members are utilized, it is within the scope of the invention to utilize but a singular wire member 53 to provide added reinforcement for the invention. However, two such wire members, being oppositely disposed at a substantially similar distance from the above bridge (41), as indicated in FIG. 1, are preferred.

In one example, each wire member 53 was comprised of platinum-clad molybdenum. Further, each wire 53 possessed a diameter less than that of the similar diameter support and lead-in conductor elements. In one specific example, the diameter of the wire members ranged from about 0.020 inch to about 0.025 inch, when used with the larger diameter (0.030 inch) support and conductor elements. It is preferred that the ratio of the diameter of each wire member 53 to the corresponding, larger diameter of the similar diameter conductor and support elements be within the range from about 0.6:1 to about 0.9:1. This is not meant to limit the invention, however, in that other diameter ratios may be utilized.

Figure 4:
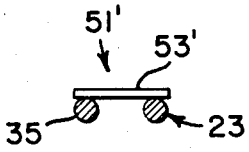
FIG. 4 is an enlarged, partial plan view of a reinforcement means in accordance with an alternate embodiment of the invention.

In FIG. 4, there is shown a support reinforcement means 51′ in accordance with an alternate embodiment of the invention. As shown, this reinforcement means comprises but a singular wire member 53′ which is attached to the respective pair of support and conductor elements (35, 23) on one side thereof. As in the case of the curvilinear (U-shaped) wires 53 above, each straight wire 53' is attached to the respective support and conductor elements by welding.

Several advantages were realized using the teachings of the instant invention. For example, use of smaller diameter and different (from the conductor and support wires being supported) wire materials for wire members 53 made it much easier to effect a weld at this location without embrittling the tungsten lead-in conductor. Additionally, use of platinum-clad molybdenum as the wire members provided an improved weld at this jointure when compared to the aforementioned weld (i.e., location "W") wherein the aforedescribed platinum tab was utilized as an interim element between the two tungsten members. Even further, the invention enabled the described enhanced reinforcement to be achieved by welding either on only one side of the respective supported elements (FIG. 4) or, alternatively, on opposite sides (FIG. 3) thus adding versatility to the manufacturing process. In either event, a more rugged mount structure resulted, which structure proved capable of withstanding the aforementioned mechanical shock to the lamp as might occur during shipment.

While there have been shown and described what are at present considered the preferred embodiments of the invention, it will be obvious to those skilled in the art that various changes and modifications may be made therein without departing from the scope of the invention as defined by the appended claims. For example, it is possible to utilize one wire member of curvilinear configuration in combination with an adjacent wire of straight configuration to attain the results described herein. It is also possible to position the two wire members at a location other than opposite each other as shown in FIG. 1. For example, the wire member shown to the right could be lowered slightly, while that to the left slightly raised (secured closer to bridge 41). In all such optional configurations, however, attachment of the respective wire members must be effected at the described location between the lower bridge (41) and the lamp's sealed end (15).

What is claimed is:

1. An electric lamp including an envelope having a sealed end portion;

a filament structure disposed within said envelope;

a first insulative bridge located within said envelope between said filament structure and said sealed end portion;

first and second lead-in conductors sealed within said end portion and extending through said first insulative bridge, said conductors being electrically coupled to said filament structure;

first and second support wires sealed in said end portion and extending within said envelope adjacent said first and second conductors for supporting said filament structures; and reinforcement means disposed within said envelope for reinforcing the support of the filament structure disposed therein, said reinforcing means interconnecting said first conductor and said first support wire and said second conductor and said second support wire, said reinforcement means being disposed at a location below said first insulative bridge and above said sealed end portion.

2. The electric lamp according to claim 1 wherein each of said first and second support wire forms a slight acute angle relative to the corresponding adjacent lead-in conductor at a location below the filament structure whereby to avoid contact with said first insulative bridge.

3. The lamp of claim 1 further including a second insulative bridge located within said envelope substantially on the opposite side of said filament structure from said first insulative bridge, said first and second support wires extending within and secured to said second insulative bridge.

4. The lamp of claim 1 wherein said first and second conductors and said first and second support wires each possess a predetermined diameter and said reinforcement means includes first and second wire members, said first wire member interconnecting said first conductor and said first support wire and said second wire member interconnecting said second conductor and said second support wire.

5. The lamp of claim 4 wherein each of said wire members possess a diameter less than said predetermined diameter of said conductors and said support wires.

6. The lamp of claim 5 wherein the ratio of said diameter of said wire members relative to said predetermined diameter of said conductors and said support wires is within the range of from about 0.6:1 to about 0.9:1.

7. The lamp of claim 4 wherein each of said wire members is of straight configuration.

8. The lamp of claim 4 wherein each of said wire members is of curvilinear configuration and engages said conductors and said support wires on opposite sides thereof.

9. The lamp of claim 4 wherein said conductors and said support wires are each comprised of tungsten and said wire members are each comprised of platinum-clad molybdenum.

* * * * *